US005837118A

United States Patent [19]

Yasui et al.

[11] Patent Number: 5,837,118

[45] Date of Patent: Nov. 17, 1998

[54] METHOD OF PRODUCING HOLLOW ELECTROFORMED PRODUCT OF PRECIOUS METAL

[75] Inventors: Shozui Yasui; Tetsuya Kotoda, both of Tokyo, Japan

[73] Assignee: M. Yasui & Co., Ltd., Tokyo, Japan

[21] Appl. No.: 598,266

[22] Filed: Feb. 7, 1996

[30] Foreign Application Priority Data

Feb. 14, 1995 [JP] Japan ..... 7-047969
Dec. 18, 1995 [JP] Japan ..... 7-347518

[51] Int. Cl.[6] ..... C25D 1/02

[52] U.S. Cl. ..... 205/73

[58] Field of Search ..... 205/73, 72

[56] References Cited

U.S. PATENT DOCUMENTS 1,219,466 3/1917 Kirk ..... 205/72
4,255,237 3/1981 Obert ..... 205/73
4,343,684 8/1982 Lechtzin ..... 205/50
4,373,933 2/1983 Grazen ..... 51/309
4,737,162 4/1988 Grazen ..... 51/293

FOREIGN PATENT DOCUMENTS 2 167 444 5/1986 United Kingdom .

*Primary Examiner*—John Niebling
*Assistant Examiner*—Brendan Mee
*Attorney, Agent, or Firm*—Oblon, Spivak, McClelland, Maier & Neustadt, P.C.

[57] ABSTRACT

A method of producing a hollow electroformed product of precious metal includes the steps of forming a hollow soluble metal electroformed layer soluble in an inorganic acid on the outer surface of a master model formed of a low melting point material or a chemically soluble material soluble in a chemical, melting or dissolving and removing the master model from inside the soluble metal electroformed layer, coating the outer surface of the remaining soluble metal electroformed layer with a masking layer, forming a precious metal electroformed layer on the inner surface of the soluble metal electroformed layer, stripping the masking layer, and dissolving the soluble metal electroformed layer with inorganic acid.

3 Claims, 3 Drawing Sheets

METHOD OF PRODUCING HOLLOW ELECTROFORMED PRODUCT OF PRECIOUS METAL

BACKGROUND OF THE INVENTION

1. Field of the Invention

This invention relates to a method of producing a hollow electroformed product of gold, silver, platinum, alloy of gold, silver, or platinum, or other such precious metal in precise conformity with a master model.

2. Prior Art Statement

Japanese Patent Public Disclosure 5-214578 teaches production of a hollow electroformed product of platinum by coating the exterior of a master model made of wax with an electrically conductive coating, applying a copper electroforming solution to the exterior of the electrically conductive coating to form a copper electroformed layer of a thickness of 50 $\mu$m, gold plating the exterior of the copper electroformed layer to a thickness of 1 $\mu$m, heating the result to melt the wax master model and discharge the wax to the exterior of the copper electroformed layer, using a platinum electroforming solution to form a platinum electroformed layer of a thickness of 100 $\mu$m on the exterior of the gold plating layer, and dissolving the copper electroformed layer with nitric acid.

Since this prior-art production method requires the copper electroformed layer to be formed on the exterior of the master model, the exterior of the copper electroformed layer to be gold plated and the platinum electroformed layer destined to become the final product to be formed on the exterior of the gold plating, patterns formed by fine hills and valleys on the surface of the master model are difficult to reproduce in the platinum electroformed layer. The products obtained are therefore of low value.

One object of this invention is to provide a method of producing a hollow electroformed product of precious metal which conforms precisely to the outer surface of a master model.

Another object of the invention is to provide a method of producing a hollow electroformed product of high-purity precious metal which has uniform thickness.

SUMMARY OF THE INVENTION

For achieving the aforesaid objects, the present invention provides a method of producing a hollow electroformed product of precious metal comprising the steps of forming a soluble metal electroformed layer soluble in an inorganic acid on the outer surface of a master model formed of a low melting point material or a chemically soluble material soluble in a chemical, melting or dissolving and removing the master model from inside the soluble metal electroformed layer, coating the exterior of the remaining soluble metal electroformed layer with a masking layer, forming a precious metal electroformed layer on an inner surface of the soluble metal electroformed layer, stripping the masking layer, and dissolving the soluble metal electroformed layer with the inorganic acid.

In accordance with a preferred aspect of the invention, formation of the final precious metal electroformed layer to a uniform thickness is ensured by, as required, dividing a master model formed of a low melting point material into multiple master model segments beforehand or dividing the soluble metal electroformed layer into multiple soluble metal electroformed layer segments to form multiple precious metal electroformed layer segments, stripping the masking layer, dissolving the soluble metal electroformed layer, and joining the precious metal electroformed layer segments to conform to the master model.

In accordance with another preferred aspect of the invention, the precious metal electroformed layer is formed on the inner surface of the soluble metal electroformed layer by inserting a platinum anode inside the soluble metal electroformed layer, and passing electric current between the platinum anode and the soluble metal electroformed layer as a cathode to form a precious metal electroformed layer on the inner surface of the soluble metal electroformed layer by means of a precious metal electroforming solution.

In this invention, when a soluble metal electroformed layer of copper or other metal soluble in an inorganic acid is formed on the outer surface of the master model as described in the foregoing, the inner surface of the soluble metal electroformed layer conforms precisely to the outer surface of the master model and since the precious metal layer is electroformed on the inner surface of the soluble metal electroformed layer, it is produced faithfully to the master model.

When the final precious metal electroformed layer is difficult to form to a uniform thickness, it is formed after either the master model or the soluble metal electroformed layer has been subdivided, thereby enabling formation to a uniform thickness. Moreover, since depositing of platinum on the electroformed layer is prevented by use of platinum as the anode at the time of forming the precious metal electroformed layer, the purity of the precious metal can be maintained high.

The above and other objects, characteristic features and advantages of this invention will become apparent to those skilled in the art from the description of the invention given hereinbelow with reference to the accompanying drawings.

BRIEF EXPLANATION OF THE DRAWINGS

FIG. 5(*b*) is a diagram for explaining how a platinum anode and an injection pipe are used to electroform a precious metal layer on the inside of a soluble metal electroformed layer coated on its outer surface with a masking layer and immersed in a precious metal electroforming solution.

FIG. 6(*b*) is a diagram for explaining how a precious metal layer is electroformed on the inside of a soluble metal electroformed layer coated on its outer surface with a masking layer by inserting a platinum pipe doubling as an anode downward into the hollow interior of the soluble metal electroformed layer and spraying a precious metal electroforming solution from the pipe.

DESCRIPTION OF THE PREFERRED EMBODIMENTS

Figure 1:
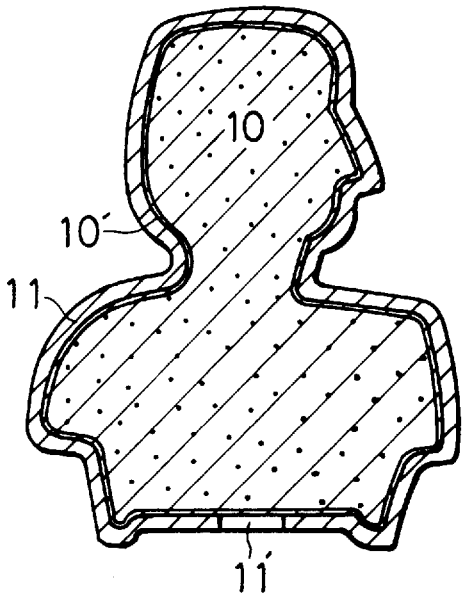
FIG. 1 is a sectional view showing a soluble metal electroformed layer formed on the outer surface of a master model.

The method of producing a hollow electroformed product according to the invention will now be explained with reference to the drawings. First, as shown in FIG. 1, a master model 10 made of a low melting point material or a chemically soluble material is formed on its outer surface with a soluble metal electroformed layer 11 which is soluble in an inorganic acid.

The low melting point material forming the master model 10 can be a wax which melts at a low temperature or, for example, a low melting point metal which melts in the vicinity of 89° C. (product of Nicem s.n.c., Italy). When the master model 10 is formed of wax, a conductive coating 10' is formed on the outer surface of the master model to provide the electrical conductivity required for electroforming a soluble metal layer on the master model 10. When the master model is made of a low melting point metal, formation of the conductive coating 10' is unnecessary because the low melting point metal is itself conductive.

Instead of forming the master model of such a low melting point material which melts at a low temperature, it is possible to form it of a chemically soluble material soluble in a chemical. For example, it can be formed of ABS resin, which is soluble in acetic acid. If the material is not conductive, the conductive coating 10' is applied to the outer surface.

The conductive coating 10' can be formed on the outer surface of a nonconductive master model 10 by coating with lacquer mixed with silver powder or by a chemical plating method such as chemical copper plating, chemical nickel plating or silver mirror plating. Use of a chemical plating method is most preferable when the master model 10 is made of a synthetic resin.

When the master model 10 has a complex shape, it is divided into multiple segments beforehand so as to enable electroforming of the final precious metal to a uniform thickness.

Metals that can be used for the soluble metal electroformed layer 11 soluble in an inorganic acid include copper, which can easily be dissolved in nitric acid and other ordinary inorganic acids (without need to use aqua regia or the like).

When a precious metal is used to produce a hollow statue (the product) of a deity, person, animal or the like, for example, a master model 10 of the statue is formed of a low melting point material (or a chemically soluble material), the conductive coating 10' is formed on the outer surface of the master model if the master model is nonconductive, the master model is immersed in, for example, a copper sulfate plating solution (200 g/l copper sulfate, 70 g/l sulfuric acid and an appropriate amount of brightening agent), and the soluble metal electroformed layer 11 is formed of copper to a thickness of 200 $\mu$m on the outside of the master model.

Figure 2:
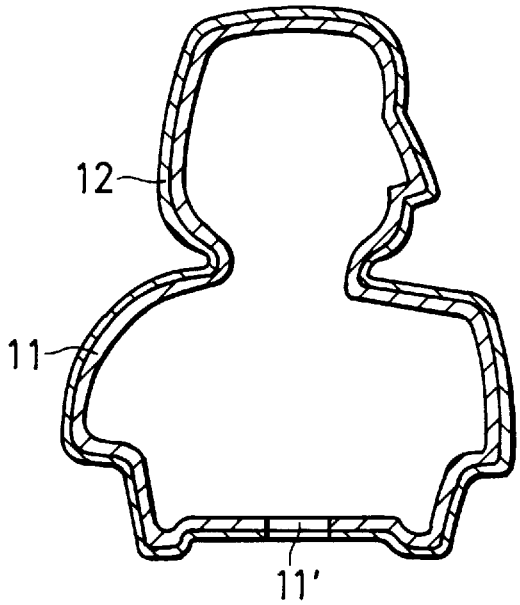
FIG. 2 is a sectional view showing the electroformed layer of FIG. 1 after having the master model removed from its interior and being coated on its outer surface with a masking layer.

Next, as shown in FIG. 2, the master model made of low melting point material is melted or dissolved and removed from the inside the soluble metal electroformed layer 11 and a masking layer 12 is coated on the outside of the remaining soluble metal electroformed layer 11.

One example of how the master model can be removed is to immerse it in a liquid heated to or above the melting point of the master model material and then drain the melted master model material from a hole 11' opened in the bottom of the electroformed layer 11. When the low melting point material of the master model is wax, it is preferable to use a 1,1,2-trichloroethylene vapor bath and immersion in combination. When the master model 10 is formed of a synthetic resin, it is dissolved by immersion in a solvent such as phenol, acetone, acetic acid, formic acid or the like.

After the master model has been removed to the outside through the hole 11' in the soluble metal electroformed layer 11, the soluble metal electroformed layer 11 is degreased by boiling, electrolysis or the like, with particular care being given to the cleaning of the hollow interior, and the outer surface thereof is then coated with the masking layer 12. The purpose of the masking layer is to prevent formation of a precious metal electroformed layer on the outer surface of the metal electroformed layer 11 when a precious metal electroformed layer 13 is formed as the product on the inside surface of the hollow soluble metal electroformed layer 11. The masking layer 12 is formed by applying a coat of masking paint or a synthetic resin such as epoxy resin to the outside of the soluble metal electroformed layer 11 and then baking and drying the applied coating by maintaining it at 180° C. for 60 min.

When the complexity of the shape of the soluble metal electroformed layer 11 makes it difficult to form the final precious metal electroformed layer to uniform thickness, the formed electroformed layer 11 is first divided into multiple segments on which the precious metal can be uniformly electroformed and the segments are then coated with the masking layer.

Figure 3:
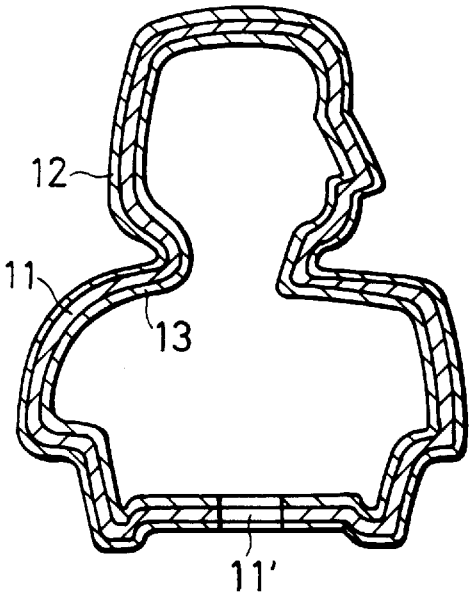
FIG. 3 is a sectional view showing the electroformed layer of FIG. 2 formed on its inner surface with a precious metal electroformed layer.

After the masking layer 12 has been formed on the outer surface of the soluble metal electroformed layer 11, the precious metal electroformed layer 13 is formed on the inner surface thereof as shown in FIG. 3.

Figure 4:
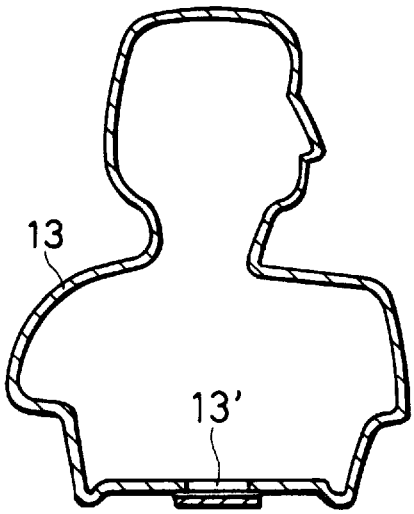
FIG. 4 is a sectional view showing the precious metal electroformed layer of FIG. 3 removed of the masking layer and the soluble metal electroformed layer.

The precious metal electroformed layer 13 is formed on the inner surface of the electroformed layer 11 as, for example, a 0.5 mm-thick layer of pure (24-karat) gold by immersing the electroformed layer 11 in a pure gold electroforming solution, immersing an electrode in the electroforming solution and supplying electric current at a current density of 0.5 A/dm$^2$ for about 40 hr. The masking layer 12 is then stripped with trichloroethylene or other such organic solvent, whereafter the soluble metal electroformed layer 11 is dissolved by immersion in a hot nitric acid solution and the remaining hollow precious metal electroformed layer 13 of pure gold is drawn up from the acid solution and cleaned to obtain the product (FIG. 4).

When the master model 10 or the soluble metal electroformed layer 11 is divided into multiple segments, the final product is fabricated by brazing or otherwise joining the so-obtained multiple precious metal electroformed layer segments in conformity with the master model.

Thus when the statue to be produced has a complicated shape, the master model of the statue is first formed of the low melting point material and then cut into multiple master model segments of shapes which are amenable to uniform final electroforming of the precious metal. (In the case of a statue of a person, for example, it is cut into front half and back half segments.) The outside of each master model segment is then formed with a soluble metal layer, which may, for example, be a 200 μm-thick layer of copper formed by electroforming in a copper sulfate plating solution.

If the master model is made of wax, the outside of each master model segment is coated beforehand with lacquer containing silver powder or the like so as to form a conductive coating thereon. If the master model is made of low melting point metal, masking paint is beforehand applied to and baked on the surface of cut sections of each master model segment, so that a copper electroformed layer should not be formed on the surface of the cut sections.

Next, the master model segments are melted away by immersion in a liquid (which may be 1,1,2-trichloroethylene when the master model is made of wax) heated to or above the melting point of the low melting point material, leaving only the copper electroformed layers.

The outside of each copper electroformed layer is then coated with masking paint and baked at 180° C. for 60 min, whereafter a precious metal electroformed layer is formed on the inside surface thereof as, for example, a 0.5 mm-thick electroformed layer of pure gold (24-karat) by immersing it in a pure gold electroforming solution and applying electric current at a current density of 0.5 A/dm$^2$. The masking paint is then stripped and the copper electroformed layer is dissolved by immersion in a hot nitric acid solution. The remaining pure gold electroformed layer is drawn up from the nitric acid solution and the final product is fabricated by brazing or otherwise joining the multiple precious metal electroformed layer segments obtained in the foregoing manner in conformity with the master model.

A specific example of producing a Buddha or human statue by a method involving subdivision of the soluble metal electroformed layer will now be explained. First, a low melting point material is formed after the statue to obtain a master model whose outer surface is then formed with a soluble metal layer, for example, a 200 μm-thick copper electroformed layer formed in a sulfate plating solution (200 g/l copper sulfate, 70 g/l sulfuric acid and an appropriate amount of brightening agent). When the master model is made of wax, its exterior is formed beforehand with an electrically conductive coating by application of, for example, lacquer containing silver powder.

The master model of low melting point material inside the copper electroformed layer is then melted and the melted material is discharged to the exterior from the hole formed in the copper electroformed layer beforehand. This removal of the master model can be conducted by immersion in a liquid heated to or above the melting temperature of the master model. When the low melting point material of the master model is wax, however, it is preferable to conduct it by combined use of a 1,1,2-trichloroethylene vapor bath and immersion.

The hollow copper electroformed layer obtained is then cut into multiple copper electroformed layer segments of shapes which are amenable to uniform final electroforming of the precious metal. (In the case of a statue of a person, for example, it is cut into front half and back half segments.) The outside of each copper electroformed segment is then coated with masking paint and baked at 180° C. for 60 min.

A precious metal electroformed layer is formed on the inner surface of each copper electroformed segment as, for example, a 0.5 mm-thick layer of pure (24-karat) gold by immersing the copper electroformed segment in a pure gold electroforming solution and applying electric current at a current density of 0.5 A/dm$^2$. The masking layer is then stripped, the copper electroformed segment is dissolved by immersion in a hot nitric acid solution, and the remaining precious metal electroformed segment of pure gold is drawn up from the acid solution. The final product is fabricated by brazing or otherwise joining the so-obtained multiple precious metal electroformed layer segments in conformity with the master model.

Figure 5A:
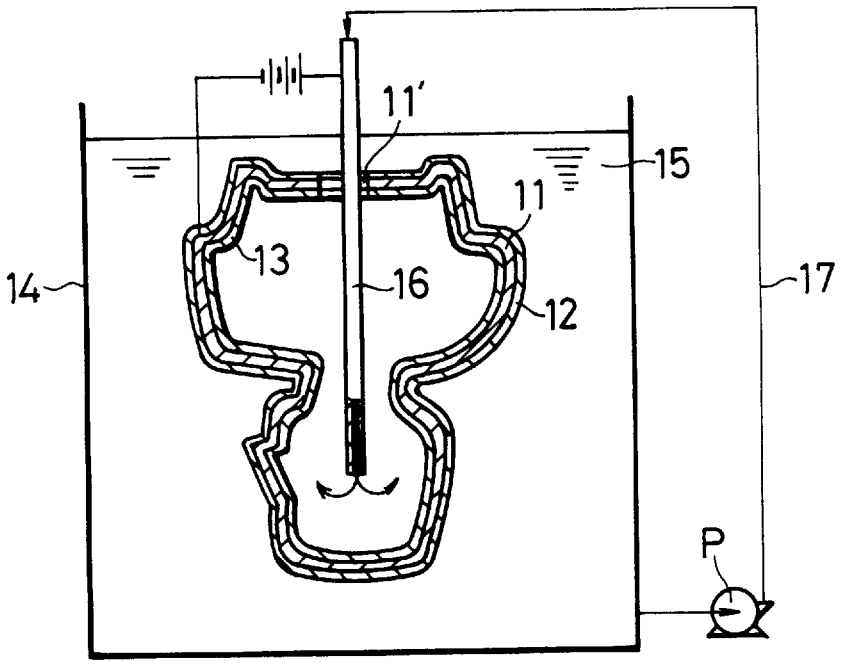
FIG. 5(*a*) is a diagram for explaining how a platinum pipe doubling as an anode is used to electroform a precious metal layer on the inside of a soluble metal electroformed layer coated on its outer surface with a masking layer and immersed in a precious metal electroforming solution.
Figure 5B:
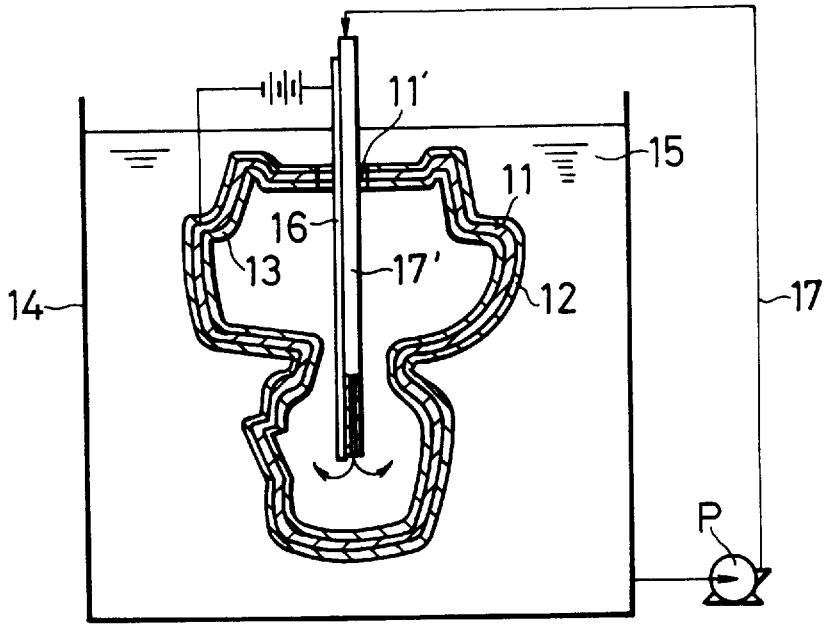

As explained in the foregoing, a precious metal electroformed layer 13 of pure gold is formed by immersion in a pure gold electroforming solution. As shown in FIGS. 5, 5(*a*), 5(*b*) a precious metal electroformed layer of high purity can be formed by immersing a soluble metal electroformed layer 11 whose outer surface is coated with a masking layer 12 in a precious metal (e.g., gold) electroforming solution 15 held in a tank 14, connecting the electroformed layer 11 with the negative pole of a d.c. power source to serve as a cathode, inserting a platinum piece 16 connected to the positive pole of the d.c. power source to serve as an anode into the interior of the soluble metal electroformed layer 11 through the hole 11', applying a current between the anode and cathode at a current density of 0.5 A/dm$^2$, and electroforming the entire inner surface of the soluble metal electroformed layer 11 by uniformly spraying it with a precious metal (e.g., pure gold) electroforming solution.

In FIG. 5(*a*), a platinum pipe is used as the platinum piece 16, the precious metal electroforming solution 15 in tank 14 is supplied to the platinum pipe by a circulation pump P and a pipe 17 made of silicon, polytetrafluoroethylene or other material resistant to chemical corrosion, and the electroforming solution 15 is uniformly sprayed on the inside of the soluble metal electroformed layer 11 by the platinum pipe.

Alternatively, as shown in FIG. 5(*b*), it is possible to use a rod as the platinum piece 16, attach the platinum piece 16 along an end portion 17' of the pipe 17 for use as the anode and use the end portion 17' of the pipe 17 to spray the precious metal electroforming solution onto the inside of the soluble metal electroformed layer. The arrangement of FIG. 5(*a*) in which the platinum pipe is used as both the anode and the spray nozzle is, however, superior in the point of achieving high uniformity in the size of the deposited particles of precious metal (gold) forming the precious metal electroformed layer and the point of achieving a high deposition speed of the particles.

Figure 6A:
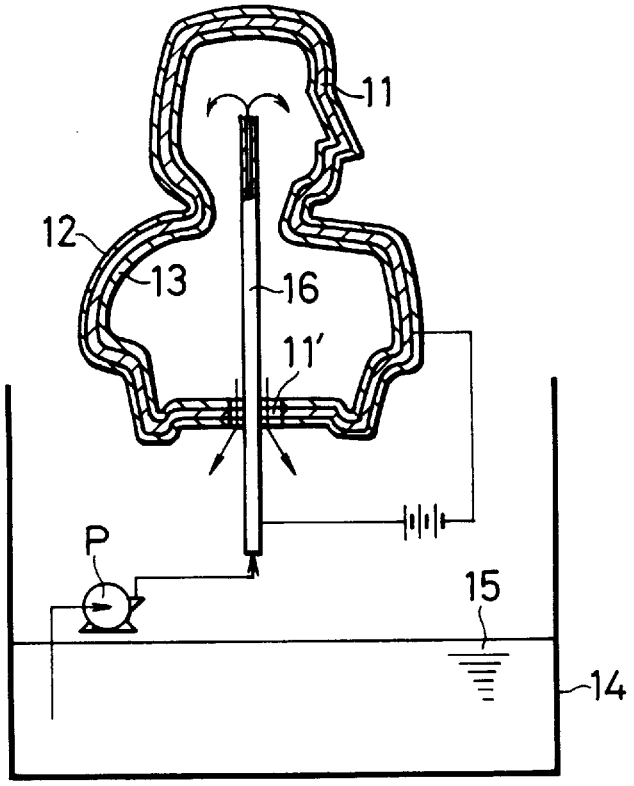
FIG. 6(*a*) is a diagram for explaining how a precious metal layer is electroformed on the inside of a soluble metal electroformed layer coated on its outer surface with a masking layer by inserting a platinum pipe doubling as an anode upward into the hollow interior of the soluble metal electroformed layer and spraying a precious metal electroforming solution from the pipe.
Figure 6B:
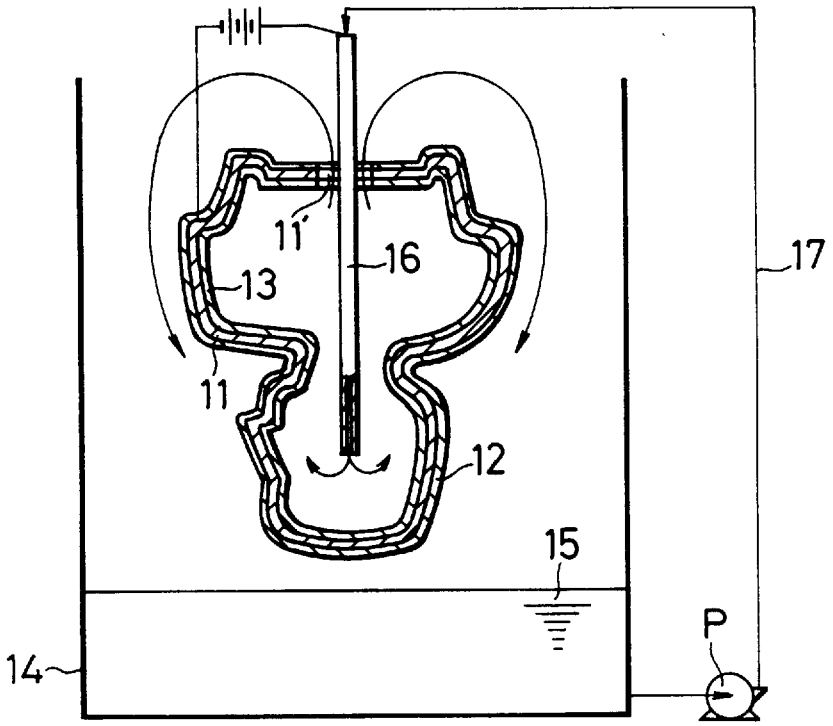

Further, as shown in FIGS. 6(*a*) and 6(*b*), the inside of the soluble metal electroformed layer 11 coated on its outer surface with the masking layer 12 can be electroformed with the precious metal electroformed layer 13 without being immersed in a precious metal electroforming solution. In this case, the hole 11' of the soluble metal electroformed layer 11 can be directed downward and the platinum anode pipe 16 be inserted upward through the hole 11' into the hollow interior of the soluble metal electroformed layer 11 or the hole 11' can be directed upward and the platinum anode pipe 16 be inserted downward through the hole 11' into the hollow interior of the soluble metal electroformed layer 11, whereafter the precious metal electroforming solution can be sprayed from the platinum anode pipe 16 so as to uniformly electroform the inside of the soluble metal electroformed layer 11.

The precious metal electroformed layer 13 produced as the product in the foregoing manner has a hole 13' corresponding to the hole 11' of the soluble metal electroformed layer. If required, a thin sheet of the same precious metal as that of the precious metal electroformed layer can be attached over the hole 11' by brazing or the like. (See FIG. 4.)

Since, as explained in the foregoing, this invention electroforms a hollow precious metal layer constituting a final product on the inner surface of a hollow interior of a soluble metal electroformed layer formed of copper or the like in precise conformity with the outer surface of a master model 10, it is possible to produce a precious metal product which is precisely faithful to the hills, valleys and other pattern feature of the outer surface of the master model and which is identical in dimensions with the master model. In addition, since platinum is used as an insoluble anode during electroforming of the precious metal electroformed layer constituting the product, no platinum is deposited as an impurity in the gold, platinum, silver or the like of the precious metal electroformed layer. It is therefore possible to maintain the precious metal of the precious metal electroformed layer at a purity of 99.99% or higher.

What is claimed is:

1. A method of producing a hollow electroformed product of precious metal, the method comprising the steps of:

forming a hollow soluble metal electroformed layer with a hole, which is soluble in an inorganic acid, on an outer surface of a master model formed of a low melting point material or a chemically soluble material soluble in a chemical;

melting or dissolving said master model within said soluble metal electroformed layer and removing it out of said hole;

coating an outer surface of the remaining soluble metal electroformed layer with a masking layer;

inserting an anode into said soluble metal electroformed layer through said hole;

applying a current between said anode and said soluble metal electroformed layer serving as a cathode and spraying an entire inner surface of said soluble metal electroformed layer with a precious metal electroforming solution, thereby forming a precious metal electroformed layer on said entire inner surface;

stripping said masking layer; and dissolving said soluble metal electroformed layer with the inorganic acid.

2. A method according to claim 1, wherein said anode is made of platinum.

3. A method according to claim 2, wherein said platinum anode is a pipe and said precious metal electroforming solution is sprayed from said pipe.

* * * * *